United States Patent [19]

Fujisaki et al.

[11] Patent Number: 4,870,724

[45] Date of Patent: Oct. 3, 1989

[54] SEPARABLE SLIDE FASTENER

[75] Inventors: Yoshinori Fujisaki, Kurobe; Kazuo Ida, Toyama, both of Japan

[73] Assignee: Yoshida Kogyo K. K., Tokyo, Japan

[21] Appl. No.: 93,608

[22] Filed: Sep. 8, 1987

[30] Foreign Application Priority Data

Sep. 9, 1986 [JP] Japan ..... 61-211876

[51] Int. Cl.[4] ..... A44B 19/36

[52] U.S. Cl. ..... 24/433; 24/434

[58] Field of Search ..... 24/433, 434, 389

[56] References Cited

U.S. PATENT DOCUMENTS

| | | | |
|---|---|---|---|
| 3,377,668 | 4/1968 | Carlile et al. | 24/434 |
| 3,435,489 | 4/1969 | Morin | 24/434 |
| 3,775,812 | 12/1973 | Carver, Jr. | 24/433 X |
| 3,892,017 | 7/1975 | Watson | 24/434 |
| 4,001,922 | 1/1977 | Ward, Jr. | 24/434 |
| 4,090,279 | 5/1978 | Wasko | 24/434 X |
| 4,138,771 | 2/1979 | Manning | 24/434 |
| 4,244,087 | 1/1981 | Akashi | 24/205.11 R |
| 4,265,004 | 5/1981 | Akashi | 24/205.11 R |
| 4,312,103 | 1/1982 | Akashi | 24/205.11 R |
| 4,425,683 | 1/1984 | Hata | 24/381 |
| 4,425,684 | 1/1984 | Akashi et al. | 24/434 |
| 4,425,685 | 1/1984 | Ogihara | 24/434 |
| 4,485,532 | 12/1984 | Yoshida et al. | 24/381 |
| 4,490,890 | 1/1985 | Yoshida et al. | 24/434 |
| 4,651,389 | 3/1987 | Yoshida et al. | 24/433 |

FOREIGN PATENT DOCUMENTS

| | | | |
|---|---|---|---|
| 572012 | 3/1959 | Canada | 24/433 |
| 2714541 | 10/1978 | Fed. Rep. of Germany | 24/433 |
| 1130567 | 2/1957 | France | 24/433 |
| 53-92406 | 7/1978 | Japan . | |
| 219911 | 8/1942 | Switzerland | 24/433 |
| 323302 | 9/1957 | Switzerland | 24/433 |
| 363596 | 12/1931 | United Kingdom | 24/434 |
| 1436084 | 5/1976 | United Kingdom | 24/434 |

*Primary Examiner*—Laurie K. Cranmer

*Attorney, Agent, or Firm*—Hill, Van Santen, Steadman & Simpson

[57] ABSTRACT

A separable slide fastener has a separable end assembly attached to reinforced bottom end portions of a pair of stringer tapes, and a pair of grip tabs each secured to the reinforced bottom end portions of the respective stringer tape and adapted to manipulate the separable end assembly. The grip tab has an inner longitudinal portion disposed adjacent to but spaced from the separable end assembly by a predetermined spacing.

9 Claims, 11 Drawing Sheets

SEPARABLE SLIDE FASTENER

BACKGROUND OF THE INVENTION

1. Field of the Invention

This invention relates to slide fasteners and more particularly to a slide fastener having a separable end assembly.

2. Prior Art

Separable slide fasteners are known which are equipped with a separator including a pin and a socket and which are widely used on garment fabrics such as trouser flies, shirts, bags, etc. When applying such a slide fastener to the edges of an opening in the garment, this could be done so that the extremities of the bottom ends of both fastener and garment are held in registry with each other, with the separator covered by the web of the garment. In such an instance, the fastener would be opened or closed by manipulating the fingers over the garment fabric to couple or uncouple the separator components. This would require delicate and dexterous technique and could be even difficult with gloves on.

The above difficulty could be overcome by making the bottom end of the fastener, which carries the separator, extend beyond the marginal bottom end of the opening in the garment so that the thus extended fastener end portions can be gripped directly to manipulate the separator with greater ease. To this end, separable slide fasteners known in the art were provided with reinforcing strips of taffeta or film material attached to the end extensions of the fastener at which the separator is located, thereby strengthening this area of the fastener. It is necessary to plug the pin member with a moderate degree of resistance into the socket member of the separator, as failing this would cause the pin member to shift out of place and would consequently prohibit coupling engagement of the two fastener stringers. However, repeated closure of the fastener under such resistance of the pin to socket assembling would weaken the reinforced fastener end portions or would often result in worn or separated reinforcing strips.

SUMMARY OF THE INVENTION

With the foregoing difficulties of the prior art in view, the present invention provides an improved separable slide fastener having a pin and a socket member which can be coupled or uncoupled with utmost ease and without impairing the fastener end portions. More specifically, the invention provides a separable slide fastener having a pin and socket assembly and means secured adjacent thereto and adapted to be gripped with the fingers of the user for taking the pin into and out of the socket with ease and accuracy.

According to the present invention, a separable slide fastener has a separable end assembly attached to reinforced bottom end portions of a pair of stringer tapes, and a pair of grip tabs each secured to the reinforced bottom end portion of the respective stringer tape and adapted to manipulate the separable end assembly. The grip tab has an inner longitudinal portion disposed adjacent to but spaced from the separable end assembly by a predetermined spacing.

The invention will become more apparent from the following detailed description taken in connection with the accompanying drawings in which like reference numerals refer to like or corresponding parts throughout the several views.

DETAILED DESCRIPTION

Figure 1:
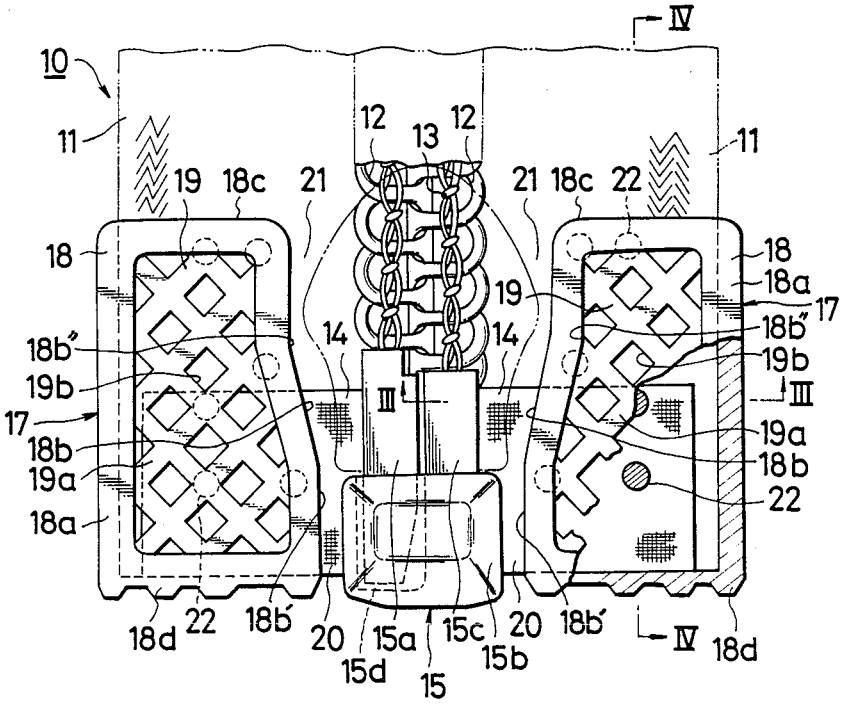
FIG. 1 is a plan view of one or bottom end portion of a separable slide fastener embodying the invention.
Figure 4:
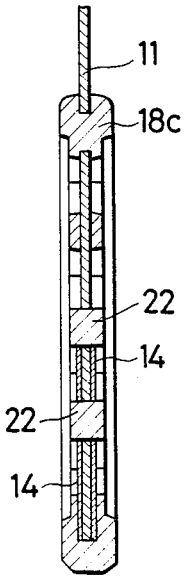
FIG. 4 a longitudinal cross-sectional view taken on the line IV—IV of FIG. 1.
Figure 3:
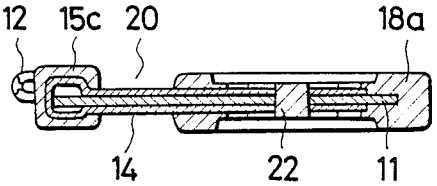
FIG. 3 is a transverse cross-sectional view taken on the line III—III of FIG. 1.

Referring to FIG. 1, there is shown one or bottom end portion of a separable slide fastener 10 which comprises a pair of stringer tapes 11 and a row of coupling fastener elements 12 secured by sewing threads 13 to and along an inner longitudinal edge of each of the stringer tapes 11.

The bottom end portion of each stringer tape 11 is covered on both surfaces substantially over its entire width with a reinforcing strip 14, which is made of a film-laminated taffeta and fused in place to render this covered tape area rigid and strong. Fusing of the reinforcing strip 14 may be done by supersonic or high-frequency welders.

A pin and socket assembly 15 is mounted in position over the reinforced strip 14 and serves when in coupled condition as an end stop to limit the movement of a slider 16 (FIG. 2) and when uncoupled to separate the two fastener stringers fully apart as is desired for this type of fastener application. The assembly 15 includes a pin member 15*a* secured to an inner edge of one of the two stringer tapes 11 and extending immediately from the terminal one of the row of coupling elements 12 shown for illustrative purposes to be of a helical formation, and a socket member 15*b* having an integral post 15*c* secured to an inner edge of the other confronting stringer tape 11 in a manner similar to the pin member 15*a*, the socket member 15*b* having a bore 15*d* for receiving the pin member 15*a*. The pin and socket assembly 15 may be made of a metal which may be clamped in place, or may be made of a plastic material which may be injection-molded onto the reinforced tape 11.

Figure 2:
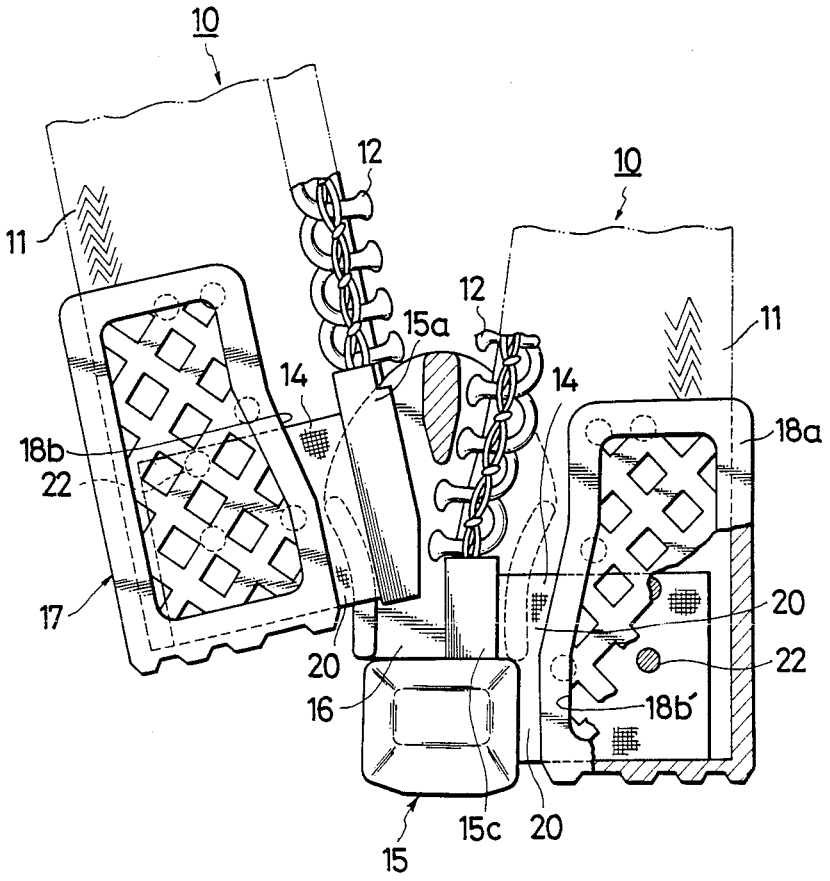
FIG. 2 is a view similar to FIG. 1 but showing the fastener in disengaged condition.

According to an important feature of the invention, there is provided a grip tab 17 with which to bring the pin 15*a* into and out of coupling engagement with the socket 15*b*. The grip tab 17 is made of a suitable synthetic resin such as nylon 66 or polyacetal which may be injection-molded onto each of the stringer tapes 11 to envelop a predetermined area of the bottom end portion on both sides of the tape 11. The grip tab 17 is generally rectangular in shape and has a peripheral frame 18 thicker than the web of the stringer tape 11 and including an outer longitudinal straight portion 18*a*, a longitudinal inner contoured portion 18*b*, and upper and lower transverse portions 18*c* and 18*d* interconnecting opposite ends of the two portions 18*a*, 18*b*, and a grated matrix 19 supportedly surrounded by the frame 18 and formed by a plularity of obliquely intercrossing bars 19*a* defining therebetween square openings 19*b*. The outer longitudinal frame portion 18*a* extends over and along the outer longitudinal edge of the bottom end portion of each stringer tape 11 and upwardly beyond the region of the reinforcing strip 14. The lower transverse frame portion 18*d* extends over and along the extreme end of the stringer tape 11. The inner longitudinal frame portion 18*b* is disposed adjacent to the inner longitudinal edge of the stringer tape 11, and includes a relatively short straight section 18*b*′ lying in close proximity to but spaced a small distance apart as at 20 from the socket member 15*b* and a relatively long section 18*b*″ divergently contoured to provide a larger spacing 21 with the counterpart on the other mating stringer tape 11. The spacing 21 between the two confronting contoured sections 18*b*″ on the respective tapes 11 is greater than the width of the widest flanged portions 16*a* of the slider 16 so as to facilitate the insertion of the pin member 15*a* through the guide channel 16*b* of the slider 16 into the bore 15*d* of the socket member 16*b* without interference between the grip tab 17 and the slider 16 as shown in FIG. 2 depicting the process of coupling the pin 15*a* with the socket 15*b*.

The provision of the spacings 20 and 21 relative to the pin and socket assembly 15 and the slider 16 is important in effecting smooth coupling engagement of the pin 15*a* with the socket 15*b*. Were it not for the spacings 20 and 21 and if the grip tabs 17 were formed integrally with the assembly 15, the separator parts at the fastener end would be rendered stiff and inflexible to render it difficult, if not possible, to engage or disengage the pin and socket assembly 15.

In the illustrated embodiment, the grip tabs 17 are secured to the tapes 11 by means of connecting portions 22 distributed over effective spots through the layers of tab 17, reinforcing strip 14 and tape web 11.

Figure 5:
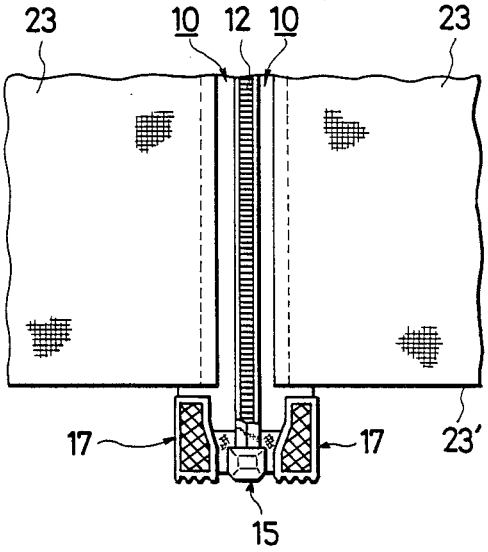
FIG. 5 is a plan view of the fastener of FIG. 1 showing the same applied to a garment fabric.
Figure 6:
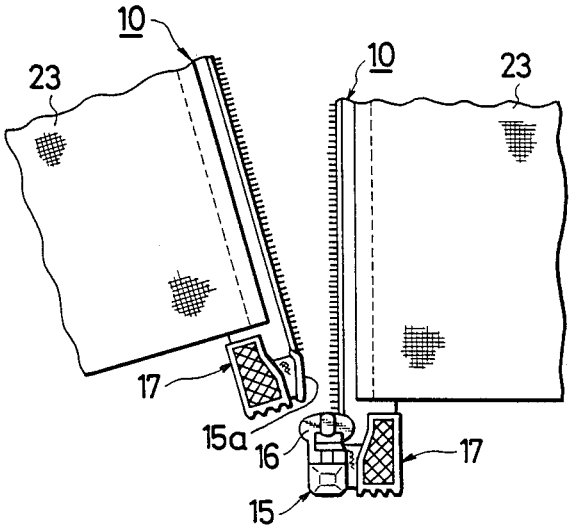
FIG. 6 is a view similar to FIG. 5 but showing two fastener stringers separated and in condition for coupling.

FIG. 5 illustrates the separable fastener 10 applied in closed condition to a garment fabric 23, with the fastener bottom end carrying the pin and socket assembly 15 and the grip tabs 17 protruding beyond the marginal end 23′ of the garment F. FIG. 6 illustrates the same separable fastener 10 in separated condition and in a posture assumed for the insertion of the pin member 15*a* into the socket member 15*b*.

Figure 7:
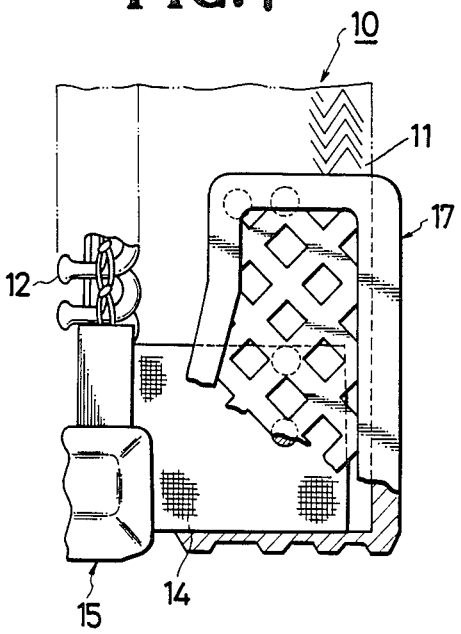
FIG. 7 is a plan view of a bottom end portion of one of the fastener stringers which is reinforced according to a modified method.
Figure 8:
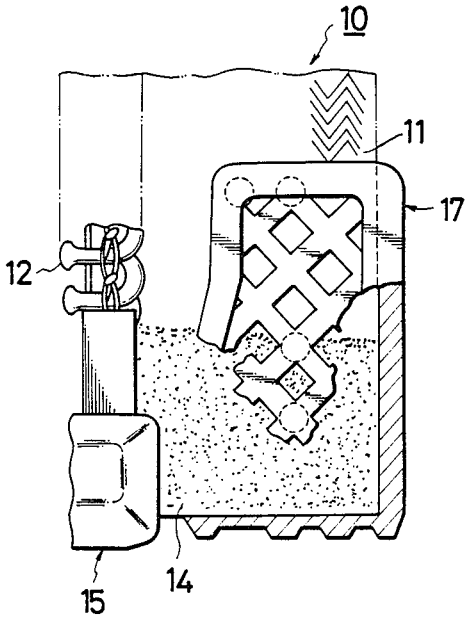
FIG. 8 is a view similar to FIG. 7 but showing another modified form of reinforced bottom end of the fastener stringer.

FIG. 7 shows a modification of the reinforcing strip 14 which is formed from a synthetic resin film, and FIG. 8 shows another which is formed by spraying or coating a plastic material over the web of the tape 11.

Figure 9:
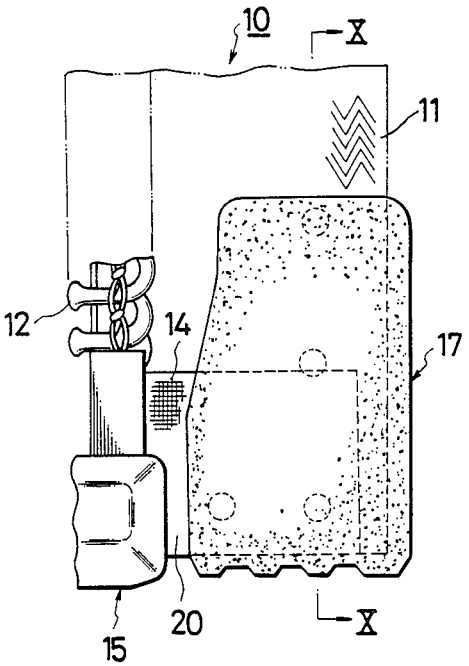
FIG. 9 is a plan view similar to FIG. 7 but showing a modified form of a grip tab according to the invention.
Figure 10A:
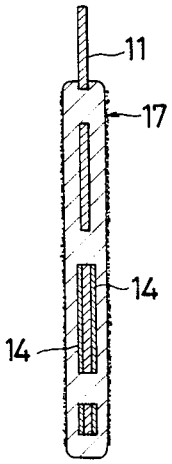
FIG. 10*a*, 10*b* and 10*c* are cross-sectional views taken on the line X—X of FIG. 9 but showing different forms of the grip tab.
Figure 10B:
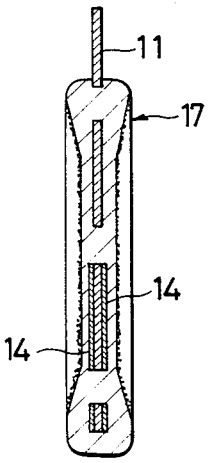
Figure 10C:
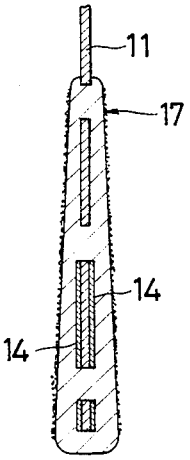

FIG. 9 shows a plate-like grip tab 17 which is coarsely surfaced on both sides to prevent slipping. FIG. 10*a* shows in cross section a grip tab 17 in FIG. 9 having a substantially uniform thickness; FIG. 10*b* shows a grip tab 17 peripherally thick and centrally thin; and FIG. 10*c* a grip tab 17 having a thickness progressively reduced toward non-reinforced tape web.

Figure 11:
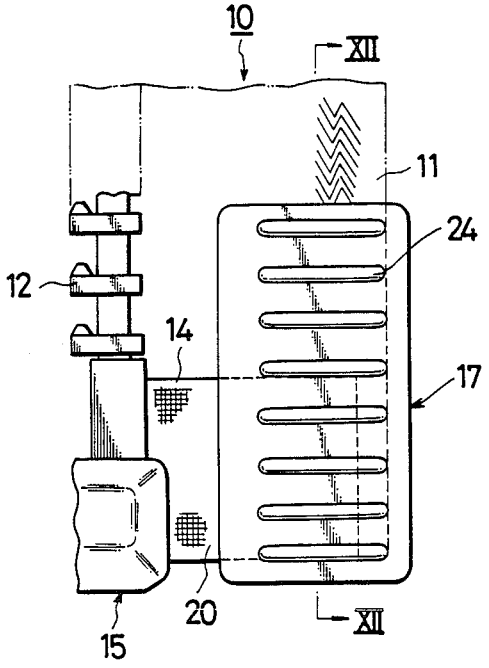
FIG. 11 is a plan view showing another modified form of the grip tab.
Figure 12:
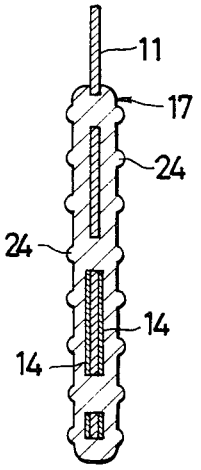
FIG. 12 is a cross-sectional view taken on the line XII—XII of FIG. 11.

The grip tab 17 according to the invention may also be a sheet of plastic material which has a plurality of transverse ridges 24 formed in spaced relation on both surfaces as shown in FIGS. 11 and 12.

Figure 13:
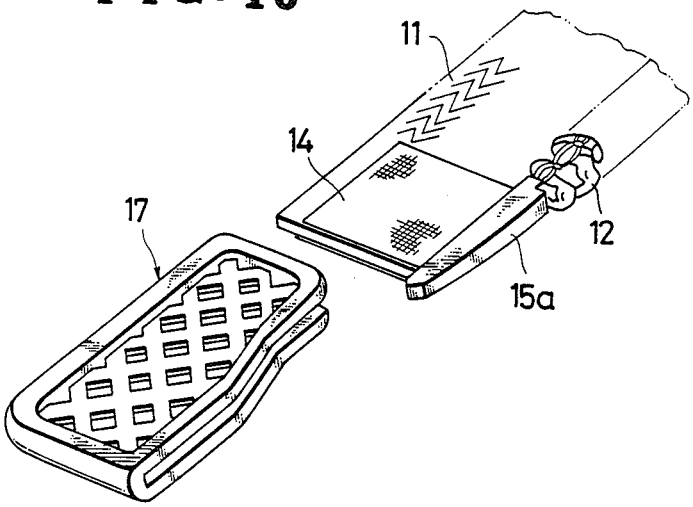
FIG. 13 is a perspective view of a prefabricated grip tab shown to be mounted on a fastener stringer.
Figure 14:
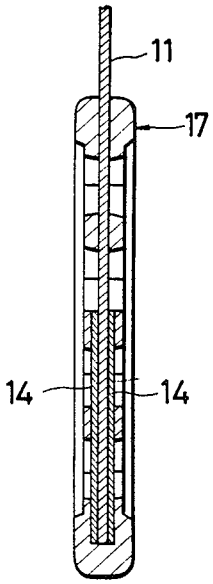
FIG. 14 is a longitudinal cross-sectional view of the grip tab of FIG. 13 which has been mounted on the stringer.

A grip tab 17 similar to that of FIG. 1 may be a separate prefab which is folded on itself over the reinforced tape end and adhesively secured or fused in place as shown in FIGS. 13 and 14.

Figure 15:
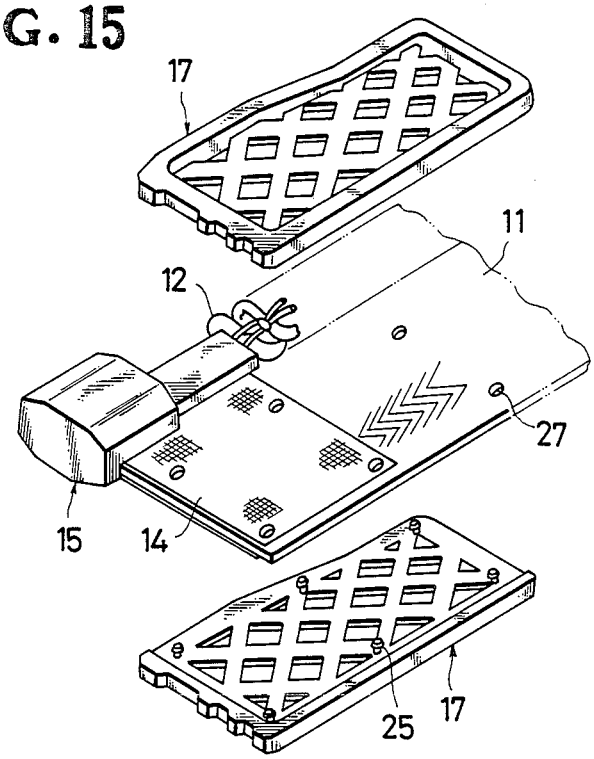
FIG. 15 an exploded perspective view of a pair of grip tabs shown prior to mounting on a fastener stringer.
Figure 16:
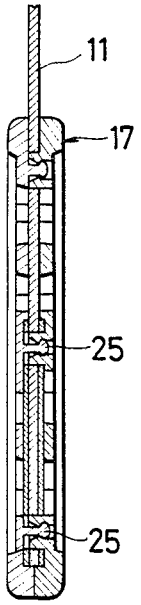
FIG. 16 is a longitudinal cross-sectional view of the grip tabs of FIG. 15 which have been mounted on the stringer.
Figure 17:
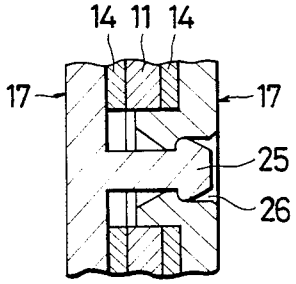
FIG. 17 is a cross-sectional view on enlarged scale of a portion of FIG. 16.

Alternatively, separate male and female pieces of a grip tab 17 may be provided one with rivets 25 and the other with receiving holes 26 to join them snappingly together over the tape end through perforations 27 therein, as shown in FIGS. 15, 16 and 17 inclusive.

Figure 18:
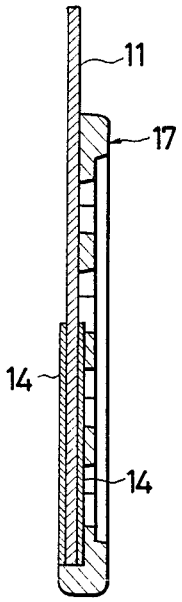
FIG. 18 is a longitudinal cross-sectional view of a grip tab mounted only on one side of a fastener stringer.
Figure 19:
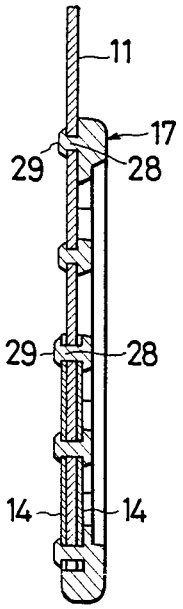
FIG. 19 a view similar to FIG. 18 but showing a different form of grip tab.

FIGS. 18 and 19 show further modifications of the grip tab 17 in which the same is applied onto only one side of the tape 11. The grip tab 17 of FIG. 18 is secured adhesively in place or by fusing a film of plastic material. The tab 17 of FIG. 19 is secured to the tape 11 by means of plastic nails 28 whose tip ends 29 are flattened out or otherwise thermally deformed and welded onto the back side of the tape 11.

Figure 20:
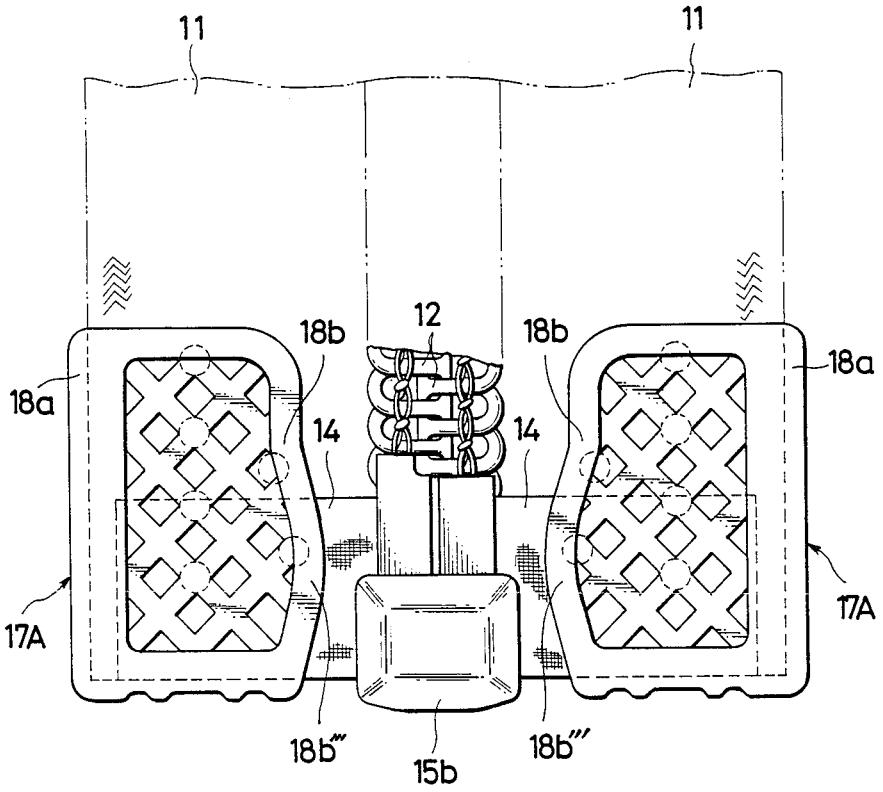
FIG. 20 is a view similar to FIG. 1, showing a different form of grip tab.
Figure 21:
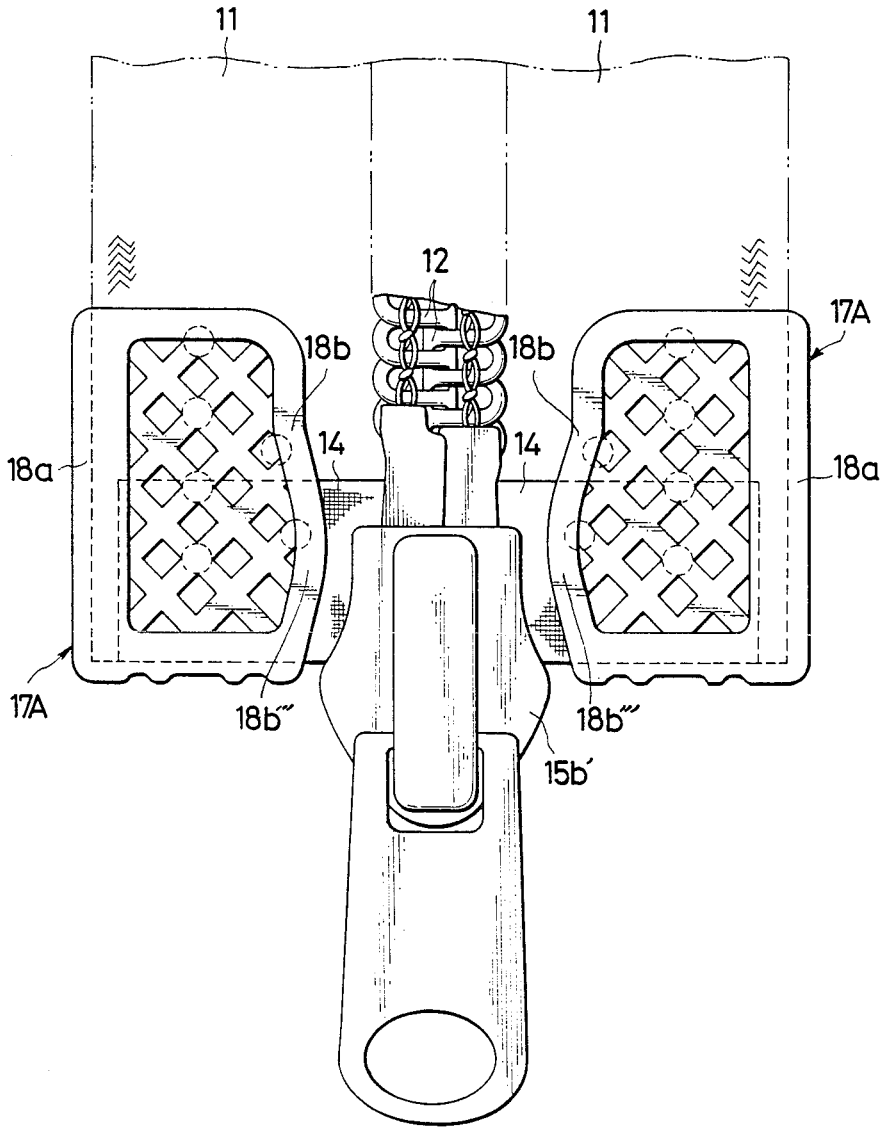
FIG. 21 is a view similar to FIG. 1, showing the grip tab applied to a bidirectionally operable slide fastener.

FIG. 20 shows a modified grip tab 17A which is different from the grip tab 17 of FIG. 1 in that the inner longitudinal frame portion 18*b* has an inwardly arcuately bulged section 18*b*‴. With this arcuately bulged section 18*b*‴, the slide fastener stringers can be selectively applied to either a single-way openable (ordinary) separable slide fastener or a bidirectionally openable separable slide fastener shown in FIG. 21. In the bidirectionally openable separable slide fastener, one of a pair of sliders 15*b*′ serves as the socket member 15*b* of FIG. 20.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A separable slide fastener comprising:

(a) a pair of stringer tapes, each tape having a bottom end portion, said bottom end portion being flat and extending in the same plane as the rest of the tape;

(b) a layer of reinforcement material disposed on said bottom end portion of each said stringer tape and overlying opposite sufaces of said stringer tape substantially over the entire width thereof for reinforcing said bottom end portion, said reinforcement layer extending along an inner longitudinal edge of said stringer tape and having a uniform thickness throughout the entire area thereof;

(c) a pair of rows of coupling elements secured to respective inner longitudinal edges of said stringer tapes;

(d) a slider threaded on said pair of rows of coupling elements, for movement therealong to take said coupling elements into and out of mutual engagement, said slider having a pair of side flanges projecting from opposite side edges thereof so as to define a guide channel for the passage of said rows of coupling elements;

(e) a separable end assembly attached to said reinforced bottom end portions of said stringer tapes and including (i) a pin member secured to the inner longitudinal edge of one of said stringer tapes and extending immediately from a terminal one of said coupling elements, said pin member being disposed on said reinforcement layer, and (ii) a socket member having an integral post secured to the inner longitudinal edge of the other confronting stringer tape and extending immediately from a terminal one of said coupling elements, said socket member having a bore for receiving said pin member and being disposed on said reinforcement layer; and (f) a pair of grip tabs each secured to said reinforced bottom end portion of a respective one of said stringer tapes and adapted to manipulate said separable end assembly, each said grip tab having a thickness greater than the thickness of said reinforced bottom end portion of said stringer tape, each said grip tab overlying said reinforcement layer and having an inner grip tab overlying said reinforcement layer and having an inner longitudinal portion disposed adjacent to but spaced from said separable end assembly by a predetermined spacing with said reinforcement layer being exposed between said inner longitudinal portion and said separable end assembly, each said grip tab having a plurality of connecting portions extending through said reinforced bottom end portion of said stringer tape, said spacing being large enough to allow passage therethrough of one of said side flanges of said slider, wherein said connecting portions of each said grip tab includes separate male and female pieces having rivets and holes, respectively, said rivets being snappingly received in said holes.

2. A separable slide fastener according to claim 1, wherein said grip tab has a generally rectangular peripheral frame and a grated matrix supportedly surrounded by said peripheral frame and composed of a plurality of oblique intersecting bars defining therebetween square openings.

3. A separable slide fastener according to claim 2, wherein said peripheral frame has a thickness greater than the thickness of said grated matrix.

4. A separable slide fastener according to claim 1, wherein said grip tab is in the form of a plate coarsely surfaced on both sides.

5. A separable slide fastener according to claim 4, wherein said plate has a substantially uniform thickness throughout the entire area.

6. A separable slide fastener according to claim 4, wherein said plate is peripherally thick and centrally thin.

7. A separable slide fastener according to claim 4, wherein said plate has a thickness progressively reduced toward a non-reinforced portion of said stringer tape.

8. A separable slide fastener according to claim 1, wherein said grip tab is a sheet having a plurality of transverse ridges formed in spaced relation on both surfaces.

9. A separable slide fastener according to claim 1, wherein said inner longitudinal portion of said grip tab has an inwardly arcuately bulged section.

* * * * *